US011223916B2

(12) United States Patent
Kamkar-Parsi et al.

(10) Patent No.: US 11,223,916 B2
(45) Date of Patent: Jan. 11, 2022

(54) METHOD FOR OPERATING A HEARING DEVICE, AND HEARING DEVICE

(71) Applicant: SIVANTOS PTE. LTD., Singapore (SG)

(72) Inventors: Homayoun Kamkar-Parsi, Erlangen (DE); Jens Hain, Kleinsendelbach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/024,991

(22) Filed: Sep. 18, 2020

(65) Prior Publication Data

US 2021/0084416 A1 Mar. 18, 2021

(30) Foreign Application Priority Data

Sep. 18, 2019 (DE) ..... 102019214220

(51) Int. Cl.
*H04R 25/00* (2006.01)
*G10L 25/51* (2013.01)

(52) U.S. Cl.
CPC ..... *H04R 25/505* (2013.01); *G10L 25/51* (2013.01); *H04R 2225/43* (2013.01)

(58) Field of Classification Search
None
See application file for complete search history.

(56) References Cited

U.S. PATENT DOCUMENTS

| | | | | |
|---|---|---|---|---|
| 8,447,596 | B2 * | 5/2013 | Avendano | G10L 21/0272 704/226 |
| 8,737,654 | B2 | 5/2014 | Merks et al. | |
| 9,973,861 | B2 | 5/2018 | Rosenkranz et al. | |
| 10,109,290 | B2 | 10/2018 | Kjems et al. | |
| 10,674,284 | B2 | 6/2020 | Best et al. | |
| 2002/0156623 | A1 * | 10/2002 | Yoshida | G10L 21/0208 704/226 |
| 2010/0226515 | A1 * | 9/2010 | Fischer | H04R 25/505 381/317 |
| 2012/0134509 | A1 * | 5/2012 | Matsumoto | G10L 21/0208 381/94.3 |
| 2013/0332157 | A1 * | 12/2013 | Iyengar | G10L 15/20 704/233 |
| 2015/0281855 | A1 | 10/2015 | Merks | |

FOREIGN PATENT DOCUMENTS

| | | | |
|---|---|---|---|
| CN | 105979460 | A | 9/2016 |
| DE | 102017221006 | A1 | 5/2019 |
| EP | 2375787 | A1 | 10/2011 |
| WO | 2015189261 | A1 | 12/2015 |

* cited by examiner

*Primary Examiner* — Paul W Huber
(74) *Attorney, Agent, or Firm* — Laurence A. Greenberg; Werner H. Stemer; Ralph E. Locher

(57) ABSTRACT

A method operates a hearing device. The hearing device has a microphone by which ambient sound is picked up and is converted into an input signal that has a wanted component and a noise component. A stationarity of the input signal is determined. A signal-to-noise ratio of the input signal is determined on a basis of a scaling factor. The scaling factor is determined on a basis of the stationarity, namely on a basis of a function that indicates the scaling factor on a basis of the stationarity of the input signal. A corresponding hearing device implements such a method.

15 Claims, 4 Drawing Sheets

METHOD FOR OPERATING A HEARING DEVICE, AND HEARING DEVICE

CROSS-REFERENCE TO RELATED APPLICATION

This application claims the priority, under 35 U.S.C. § 119, of German application DE 10 2019 214 220, filed Sep. 18, 2019; the prior application is herewith incorporated by reference in its entirety.

BACKGROUND OF THE INVENTION

Field of the Invention

The invention relates to a method for operating a hearing device and to a hearing device.

A hearing device is generally used to output sound to a user of the hearing device. To this end, a hearing device initially has a microphone that is used to pick up sounds from the surroundings, i.e. ambient sound. This generates an electrical input signal that is supplied to a signal processing section for further processing. The signal processing section then generates an electrical output signal that is output to the user via a receiver of the hearing device as sound. A hearing device is typically worn by the user in or on the ear.

One specific configuration of a hearing device is a hearing device to compensate for a hearing deficiency in a user with impaired hearing. In such a hearing device the input signal is modified in the signal processing section on the basis of an individual audiogram of the user and is typically amplified in the process in order to compensate for the hearing deficiency.

The response of the hearing device is normally characterized by one or more operating parameters that are adjustable depending on the situation in order to ensure the best possible hearing experience in different ambient situations. In order to adjust the hearing device depending on the situation, it is necessary to characterize or classify the ambient situation. One important parameter therefor is the signal-to-noise ratio of the surroundings, i.e. the ratio of the wanted signal to the noise signal. A wanted signal is a signal that is of interest to the user and is therefore intended to be output to him as clearly as possible, for example the voice of a speaker with whom the user is conversing. A noise signal, on the other hand, is a signal that is intended to be rejected, since it masks the wanted signal and therefore adversely affects the intelligibility thereof. Examples of noise signals are what is known as "babble noise", background sounds, other speakers with whom the user is not conversing and ambient or machine sounds.

The signal-to-noise ratio is not readily available, since calculation thereof requires the levels of the wanted component and the noise component to be ascertained separately so as subsequently to determine the ratio thereof. Since wanted signals and noise signals are present at the same time, however, they overlap and are picked up by the microphone together. The input signal therefore normally contains both a wanted component and a noise component. Separation of these two components for the purpose of calculating the signal-to-noise ratio is not readily possible. An approximate calculation by means of other variables with better availability is sometimes severely flawed.

BRIEF SUMMARY OF THE INVENTION

Against this background, it is an object of the invention to specify an improved method for operating a hearing device, and a corresponding hearing device. Specifically, the determination of the signal-to-noise ratio in the surroundings is intended to be improved. In particular, the best possible estimation of the signal-to-noise ratio is intended to be performed. The estimation is intended to require in particular no explicit separation of the wanted component and the noise component.

The object is achieved according to the invention by a method having the features of the independent method claim and by a hearing device having the features of the independent hearing device claim. Advantageous configurations, developments and variants are the subject of the subclaims. The explanations in connection with the method also apply mutatis mutandis to the hearing device, and vice versa. Where method steps are described below, advantageous configurations are obtained for the hearing device in particular by virtue of the hearing device being designed to carry out one or more of these method steps.

The method is used for operating a hearing device and is accordingly a method of operation. During the method, the hearing device is in particular worn by a user in or on the ear and used to output ambient sound. The hearing device has a microphone by means of which ambient sound is picked up and is converted into an input signal. The microphone is preferably an omnidirectional microphone, i.e. not a directional microphone, and therefore in particular has no preferential direction for picking up sound. Analogously, the input signal is preferably an omnidirectional signal. The ambient sound is an acoustic signal. The input signal is an electrical signal. The input signal has a wanted component and a noise component. The wanted component is a signal that is of interest to the user and is therefore intended to be output to him as clearly as possible. The noise component, on the other hand, is a signal that is intended to be rejected, since it masks the wanted component and therefore adversely affects the intelligibility thereof. The hearing device furthermore preferably has a signal processing section to which the input signal is supplied for further processing. The signal processing section then generates an electrical output signal that is output to the user via a receiver of the hearing device as sound.

The method involves a stationarity of the input signal being determined. To this end, the hearing device, and in particular the signal processing section thereof, expediently has a stationarity detector, to which the input signal is supplied and which outputs the stationarity. Stationarity is generally understood to mean a measure of the variability of a signal over the course of time. A signal that changes little over time has a higher stationarity than a signal that changes to a greater extent in comparison. The stationarity of a signal in general is measured for example by virtue of the change in a frequency spectrum of the signal over time being measured and a value for the stationarity then being derived therefrom. The less and the more slowly the frequency spectrum changes, the higher the stationarity. Alternatively or additionally, the signal, specifically the frequency spectrum thereof, is examined for one or more predefined features and the stationarity is determined on the basis of the presence or strength of these features.

The method involves a signal-to-noise ratio of the input signal being determined, preferably continually, on the basis of a scaling factor. The signal-to-noise ratio is also referred to simply as SNR for short. The signal-to-noise ratio is a measure of the relevant components of the wanted component and the noise component in the overall input signal and hence also in the ambient sound. The scaling factor is determined on the basis of stationarity, namely on the basis of a function that indicates the scaling factor on the basis of the stationarity of the input signal. The function is stored in a memory of the hearing device, specifically of the signal processing section, for example. The function preferably has a range of values from 0 to 1, particular preferably from 0.5 to 1, for the scaling factor. In other words: the function preferably returns a value in the range from 0 to 1, particularly preferably from 0.5 to 1. Other value ranges are also possible and suitable, in principle.

The signal-to-noise ratio is expediently used during operation of the hearing device to adjust the latter on the basis of the situation and hence in as optimum a fashion as possible. In other words: an operating parameter of the hearing device is expediently adjusted on the basis of the signal-to-noise ratio. The signal-to-noise ratio is preferably also smoothed prior to use, e.g. by means of temporal, in particular rolling, averaging.

An essential aspect of the invention is the stationarity-dependent scaling factor, the use of which determines the signal-to-noise ratio on the basis of the stationarity of the input signal. This means that determination of the signal-to-noise ratio is significantly more precise and improved adjustment of the hearing device is achieved.

The invention is based on the initial assumption that the input signal contains both a wanted component and a noise component and that these two components are initially not available separately for calculating the signal-to-noise ratio. In the present case the signal-to-noise ratio is therefore determined, to be more precise estimated, on the basis of the input signal. The signal-to-noise ratio determined using the method thus does not necessarily correspond to the actual signal-to-noise ratio, but rather is an estimate. In other words: the signal-to-noise ratio is calculated approximately, in particular without precise knowledge of the wanted component and the noise component.

Environments with a high noise component are typically correspondingly loud, i.e. the applicable input signal has a high level. Such a high level frequently, but not necessarily, results in the noise component being large relative to the wanted component, which means that the signal-to-noise ratio is thus low. In a first approximation, a simple level measurement on the input signal can therefore produce a rough estimation of the signal-to-noise ratio that is likely present. This approach is problematic, however, since situations are also possible in which the noise component is low but the wanted component itself is, by contrast, very loud. Although the signal-to-noise ratio is then high, the level is too, which means that the estimation on the basis of the simple level measurement is accordingly erroneous.

The aforementioned problem will be described below on the basis of a specific instance of application: in an expedient configuration a directionality of the hearing device is adjusted on the basis of the signal-to-noise ratio. Directionality generally refers to focusing the hearing device on one specific hearing direction by attenuating or masking out other directions. This is accomplished by using a beamformer, for example, which has a directional lobe having an adjustable width. The width of the directional lobe is then adjusted on the basis of the signal-to-noise ratio. The lower the signal-to-noise ratio, the smaller the width is set, so that only signals that come from a specific direction and are predominantly wanted signals are then output to the user. Noise signals from other directions are therefore masked out. If a single speaker in otherwise quiet surroundings now speaks very loudly, a low width and hence a high directionality are set on the basis of the high level, however, even though this is not necessary per se. This means that signals outside the directional lobe are lost, even though they would advantageously contribute to a generally more natural hearing experience without adversely affecting the intelligibility of the wanted component too much.

In the present case the signal-to-noise ratio is estimated and additionally the stationarity of the input signal is taken into consideration, so that the estimate of the signal-to-noise ratio is improved on the whole. With the stationarity the estimate acquires an additional dimension as it were, which allows distinction and classification of the ambient situation. Applied specifically to the instance of application described by way of example above, this means: if the noise component is low but the wanted component is very loud, the stationarity of the input signal is low on the whole, whereas in the case of a loud noise component the stationarity is high in comparison. Despite a similar level it is then possible for situations with a greatly different actual signal-to-noise ratio to be reliably distinguished, and the surroundings are classified correctly. The estimated signal-to-noise ratio is accordingly adjusted by means of the scaling factor and then more likely corresponds to the actual signal-to-noise ratio. Apart from the instance of application explicitly cited, any adjustment of the hearing device that is performed on the basis of the signal-to-noise ratio is therefore significantly improved.

Specifically, how the signal-to-noise ratio is calculated is initially unimportant for the underlying concept; instead it is initially only significant that the stationarity is taken into consideration. In respect of calculation of the signal-to-noise ratio, however, a configuration in which an input level of the input signal is measured and in which an estimated noise component of the input signal is determined is particularly preferred. The estimated noise component is multiplied by the scaling factor, so that a scaled, estimated noise component is obtained. The signal-to-noise ratio is then calculated by forming a difference from the input level and the scaled, estimated noise component and by calculating the signal-to-noise ratio as the ratio of the difference to the scaled, estimated noise component. This approach is expressed by the following formula:

$$SNR=(E-sc*N_est)/sc*N_est=(S+N-sc*N_est)/sc*N_est.$$

where E=S+N is the input level, made up of the wanted component S (signal) and the noise component N (noise). The scaling factor is denoted by sc, the estimated noise component by N_est. The scaled, estimated noise component accordingly corresponds to sc*N_est.

Both the input level and the estimated noise component are derived directly from the input signal, in particular without knowledge of the wanted component and the noise component on their own, i.e. the noise component and the wanted component are not separated.

It is fundamentally possible to determine the signal-to-noise ratio by calculating the ratio of the input level to the estimated noise component, so that the input level is used as an approximation of the actual wanted component and the estimated noise component is used as an approximation of the actual noise component:

$$SNR=E/N_est=(S+N)/N_est.$$

For a very low wanted component in comparison with the noise component, i.e. for S<<N, and assuming that the noise component roughly corresponds to the estimated noise component, i.e. N N_est, this formula delivers only positive values for the signal-to-noise ratio, measured in dB. In other words: cases with a negative signal-to-noise ratio (in dB) cannot be represented.

A negative signal-to-noise ratio can be represented, on the other hand, in an advantageous configuration in which the estimated noise component is first subtracted from the input signal:

$$SNR=(S+N-N_est)/N_est.$$

Additionally, the stationarity-dependent scaling factor is expediently applied in order to set the proportion and influence of the estimated noise component, so that the formula already cited above is obtained:

$$SNR=(S+N-sc*N_est)/sc*N_est.$$

In a likewise suitable variant the scaling factor in the denominator is omitted and the estimated wanted component in the numerator is merely divided by the estimated noise component. Although the use of the scaling factor in the denominator leads to an additional offset, this is small. By contrast, advantageously simplified handling and implementation of the calculation is available as a result of the use of the scaling factor in the denominator, since calculation of the signal-to-noise ratio then requires just two variables, namely the input level and the scaled, estimated noise component.

The scaling factor allows the signal-to-noise ratio to be determined more precisely and estimated with lower error. If the wanted component is larger than the noise component, expediently no or just a small correction is performed by means of the scaling factor. The smaller the wanted component in comparison with the noise component, however, the higher the stationarity of the input signal on the whole and the more the input signal is dominated by the noise component. Greater compensation is needed here in order to also represent a negative signal-to-noise ratio if necessary. Accordingly, greater stationarity results in a greater scaling factor being applied, so that the estimate of the wanted component, which is expressed by the numerator (S+N−sc*N_est), is corrected downward to a greater extent.

Preferably, the hearing device has a first level meter, which is used to determine the input level, and an, in particular separate, second level meter, which is used to determine the estimated noise component. The input signal is accordingly supplied to two different level meters. The level meters are in particular parts of the signal processing section. One level meter is used to measure the input level; the other level meter is used to estimate the noise component in the input signal by virtue of the second level meter being adjusted such that it primarily measures the level of the noise component, that is to say responds to the wanted component less acutely than to the noise component. The two level meters are accordingly configured differently in order to perform different level measurements on the same signal, namely the input signal.

All in all, determination of the signal-to-noise ratio therefore requires just two level meters and a stationarity detector, each of which is supplied just with the input signal. In an expedient and particularly simple configuration the signal-to-noise ratio is then ascertained just by means of two level measurements and a stationarity measurement on the input signal. An advantageous development also has one or more further measurements added.

In one suitable configuration the estimated noise component is determined using a level meter that is operated with two asymmetric time constants. This level meter is in particular the aforementioned second level meter for determining the estimated noise component. The use of an asymmetric level meter of this kind distorts the level measurement on the input signal and focuses it on the noise component.

A configuration in which the level meter, i.e. in particular the second level meter, is operated with an attack that is longer than a release of the level meter is particularly advantageous. Such a level meter having a slow attack and a fast release is also referred to as a "minimum tracker". The attack and the release are each a time constant of the level meter. The greater, i.e. longer, attack in comparison with the release produces a corresponding inertia in the response of the level meter, which leads to the wanted component, which is assumed to be less stationary or even nonstationary in comparison with the noise component, contributing to the level measurement less than the noise component, which is assumed to be stationary in comparison with the wanted component.

The function that indicates the scaling factor on the basis of the stationarity of the input signal is preferably in a form such that a greater scaling factor is determined when the stationarity of the input signal is greater. In other words: the function returns a greater scaling factor for a greater stationarity. This is based on the consideration that the wanted component is more likely nonstationary in comparison with the noise component, and, vice versa, that the noise component is more likely stationary in comparison with the wanted component. A greater stationarity therefore indicates a poorer, i.e. lower, signal-to-noise ratio. With greater stationarity of the input signal the proportion of the wanted component in the input signal is accordingly lower, which means that a larger correction is required, which is then achieved by the greater scaling factor. In a particularly simple configuration, the function is linear or alternatively partially linear and otherwise constant.

The function is stored for example as a computation rule or as a table in a memory of the hearing device, specifically of the signal processing section.

In an expedient configuration the function is predefined by means of a calibration measurement. The calibration measurement involves an actual signal-to-noise ratio being determined for different ratios of a wanted component and a noise component and the actual signal-to-noise ratio being compared with the calculated signal-to-noise ratio. The signal-to-noise ratio is preferably calculated using the aforementioned formula, so that the scaling factor then remains as a variable and is determined, in particular using the following or a similar formula:

$$sc=(S+N)/(N_est*((S/N)+1)).$$

A known noise component is thus mixed with a known wanted component to obtain an input signal, the actual noise component and actual wanted component of which are therefore known. The actual signal-to-noise ratio is then determined using SNR=S/N and compared with the result of the estimation of the signal-to-noise ratio, and the scaling factor is ascertained therefrom. The estimated noise component is also logically ascertained, in particular as provided for in the method. This is then repeated for multiple different signal-to-noise ratios. The stationarity of the input signal is likewise determined for each signal-to-noise ratio, so that all in all the scaling factor is represented as a function of the stationarity.

The noise component per se does not necessarily have to be stationary, however, but rather may also be nonstationary and, like the input signal, has a fundamentally variable stationarity all in all. An example of a noise component with low stationarity is what is known as "babble noise". An example of a noise component with high stationarity is what is known as long-term average speech spectra, LTASS for short. Depending on the stationarity of the noise component the estimation of the signal-to-noise ratio in accordance with the procedure sometimes delivers different results even though the actual signal-to-noise ratio SNR=S/N is actually the same. The results typically differ more in particular the lower the actual signal-to-noise ratio. The overall problem therefore results that, particularly in the case of an input signal in which the wanted component is small in comparison with the noise component and in which the noise component has a low stationarity, the wanted component is overestimated and the estimate of the signal-to-noise ratio in accordance with the procedure differs from the actual signal-to-noise ratio, namely in particular is too high, i.e the signal-to-noise ratio is overestimated. This is related in particular to the estimation of the estimated noise component, since determination thereof using the level meter described above involves primarily stationary components being taken into consideration. A highly nonstationary noise component is therefore captured only incompletely or not at all, which means that the noise component is increasingly underestimated as the stationarity thereof decreases. This problem is solved in an advantageous configuration by virtue of the function for the scaling factor being adapted on the basis of a stationarity of the noise component. The scaling factor is accordingly determined firstly on the basis of a first stationarity, namely the stationarity of the input signal on the whole, and secondly additionally also on the basis of a second stationarity, namely the stationarity of the noise component. The stationarity of the noise component per se is not necessarily actually measured, but rather is expediently determined indirectly by virtue of input dynamics of the input signal being determined and it then being assumed that the stationarity of the noise component is greater with lower input dynamics. In other words: the stationarity of the noise component is suitably determined by virtue of it being assumed below a threshold value for input dynamics of the input signal that there is a stationary source of interference and the noise component is therefore stationary, that is to say has a specific stationarity.

The function is advantageously adapted on the basis of the stationarity of the noise component such that the function returns a greater scaling factor for a lower stationarity of the noise component, i.e. the scaling factor is corrected upward, so that the scaled, estimated noise component is greater as stationarity decreases, and the underestimation of the noise component is corrected.

The stationarity of the noise component is determined in a suitable configuration by virtue of the temporal dynamics of the input signal (i.e. the input dynamics) being analyzed, namely by virtue of a maximum level and a minimum level of the input signal being ascertained and compared with one another. To this end, a third and a fourth level meter are expediently used that are supplied with the input signal. The third level meter measures the maximum level, whereas the fourth level meter measures the minimum level, or vice versa. To this end, the two level meters are expediently operated firstly each with asymmetric time constants and secondly with time constants that are the opposite of one another. This is understood to mean that the level meter that measures the maximum level is operated with a short attack and a long release and the level meter that measures the minimum level is conversely operated with a long attack and a short release.

By way of example the difference between or the ratio of the maximum level and the minimum level is then ascertained. The maximum level and the minimum level are preferably determined continually within a concurrent time interval. In this way, the stationarity of the noise component is advantageously ascertained on the basis of the input signal without having to know the noise component itself. This exploits the circumstance that, specifically when the actual signal-to-noise ratio is low, a higher stationarity of the noise component leads to a smaller difference between the maximum level and the minimum level. In other words: the smaller the difference, the higher the stationarity for a given signal-to-noise ratio. The statements apply analogously when the ratio of the maximum level and the minimum level is used. In one configuration the ratio or the difference is used directly as a measure of the stationarity of the noise component.

The use of multiple different functions optimized for noise components having different stationarity is particularly expedient.

In one expedient configuration the function for the scaling factor is adapted on the basis of a stationarity of the noise component by virtue of the function for the scaling factor being selected from at least two basic functions on the basis of the stationarity of the noise component. Depending on the stationarity, one of multiple basic functions is accordingly selected in order to obtain an optimum scaling factor depending on the ambient situation. In a particularly simple exemplary embodiment there are two basic functions available, a first basic function for stationary or predominantly stationary noise components and a second basic function for nonstationary or predominantly nonstationary noise components. The method first involves the stationarity of the noise component being determined, in particular as already described, from the input signal. Depending on the stationarity, one of the basic functions is then selected and used as a function in order to determine the scaling factor. A switch or cut to the basic function for stationary or predominantly stationary noise components is preferably made as soon as input dynamics of the input signal drop below a predefined threshold value, that is to say are sufficiently low.

As an alternative to the aforementioned discrete selection from multiple basic functions, a likewise advantageous configuration involves the function for the scaling factor being adapted on the basis of a stationarity of the noise component by virtue of the function being mixed from multiple basic functions and on the basis of the stationarity of the noise component. To this end, a suitable configuration involves there being two basic functions available, and the function is determined by virtue of the two basic functions being mixed with one another in a mix ratio that is dependent on the stationarity of the noise component. This achieves a particularly soft transition when using different basic functions. The basic functions are expediently in a form as already described above.

To mix the basic functions, the hearing device, specifically the signal processing section thereof, in a suitable configuration has a mixer to which the scaling factors from multiple basic functions are supplied. The mixer then mixes these scaling factors in an appropriate mix ratio on the basis of the stationarity and then itself outputs a scaling factor, which is finally multiplied by the estimated noise component in order to ascertain the scaled, estimated noise component.

The calibration measurement described earlier on is expediently applied analogously in order to determine different basic functions. The calibration measurement is then performed not only for different signal-to-noise ratios but rather repeatedly for different signal-to-noise ratios, wherein a noise component having a different stationarity is used in each case. In a particularly simple exemplary embodiment, the calibration measurement is performed twice, once with a noise component having low stationarity and once with a noise component having high stationarity, so that the calibration measurement delivers two corresponding basic functions.

In one suitable configuration the hearing device has multiple frequency channels, so that the input signal is split over these multiple frequency channels. The frequency channels are then modifiable individually by the signal processing section. For the purpose of output, the frequency channels are in particular combined again. For example a filter bank is used for the purpose of splitting over the different frequency channels. All in all, the hearing device has in particular at least 2, preferably at least 3, frequency channels and preferably 8 to 128 frequency channels. For example a configuration having 48 frequency channels is suitable.

The input signal extends over a specific frequency range, in particular the audible frequency range from 20 Hz to 20 kHz or a subrange thereof, preferably from 100 Hz to 12 kHz. The signal-to-noise ratio is then ascertained either over the entire frequency range of the input signal or just over a subrange.

In a particularly expedient configuration the hearing device has multiple frequency channels as described and the signal-to-noise ratio is calculated for each frequency channel from a partial number of the frequency channels as described above, so that multiple signal-to-noise ratios are obtained, from which a mean value is then formed that is an averaged signal-to-noise ratio, which is also referred to as a global signal-to-noise ratio. An individual, local signal-to-noise ratio is ascertained for each of the partial number of the frequency channels, separately as it were. The estimation of the signal-to-noise ratio therefore explicitly does not involve all frequency channels being taken into consideration, but rather some frequency channels are omitted by virtue of just a partial number of the frequency channels being taken into consideration. This advantageously allows the estimation of the signal-to-noise ratio to be restricted to the more relevant frequency channels, and hence operation of the hearing device to be optimized further. The mean value is formed in particular by means of an averaging unit of the hearing device, specifically of the signal processing section. The partial number of the frequency channels preferably covers a single coherent frequency range, but this is not imperative. A configuration in which multiple averaged signal-to-noise ratios are ascertained, namely for different frequency ranges, is also suitable.

The determination of the signal-to-noise ratio does not necessarily completely have to be performed separately for each of the frequency channels; instead it is sufficient for individual calculations, determinations, ascertainments or measurements to be performed on a frequency-dependent basis, i.e. for individual frequency channels, with other calculations, determinations, ascertainments or measurements then being performed globally, i.e. not on a frequency-dependent basis. By way of example, the input level is ascertained on a frequency-dependent basis and therefore separately for each individual frequency channel, but the estimated noise component is ascertained globally on the basis of the summed input level of all frequency channels. In another exemplary and suitable variant the stationarity of the input signal is determined on a frequency-dependent basis, is averaged, and then the scaling factor is determined and the input level and the estimated noise component are contrastingly ascertained globally. A configuration in which the estimated noise component is determined not globally but rather on a frequency-dependent basis is also suitable.

A configuration in which the partial number of the frequency channels covers a frequency range up to 1.5 kHz, i.e only low frequencies are taken into consideration for the estimation of the signal-to-noise ratio, is particularly expedient. This is based on the consideration that the frequency range is more relevant for the perception of volume by the user than other frequency ranges. Variants in which other frequency ranges are alternatively or additionally covered are also possible and likewise suitable, however.

As already indicated, an operating parameter of the hearing device is adjusted on the basis of the estimated signal-to-noise ratio. In a preferred configuration the operating parameter is a parameter of a beamformer, e.g. a directionality or a width of a directional lobe of the beamformer, or a parameter of a noise reduction system, e.g. an attenuation factor or a filter frequency or a filter frequency band of a filter. The improved ascertainment of the signal-to-noise ratio also all in all accordingly improves the adjustment of the operating parameter and the operation of the hearing device. As such, for example the width of the directional lobe of a beamformer is reduced for greater signal-to-noise ratios, i.e. a spatial filter is narrowed in order to achieve focusing by means of which noise components from the surroundings are rejected.

The hearing device is preferably a hearing device to compensate for a hearing deficiency in a user with impaired hearing. In such a hearing device the input signal is modified in the signal processing section by means of a modification unit on the basis of an individual audiogram of the user and is in particular amplified in the process in order to compensate for the hearing deficiency. The method described is advantageously also applicable to other hearing devices, however, e.g. headphones, headsets, telephones, smartphones and the like.

One or more of the functions or method steps described are implemented in the hearing device and specifically in the signal processing section thereof in particular by programming or circuitry, or a combination thereof. To perform one or more of the functions or method steps described, the signal processing section is for example in the form of a microprocessor or in the form of an ASIC, or in the form of a combination thereof.

Other features which are considered as characteristic for the invention are set forth in the appended claims.

Although the invention is illustrated and described herein as embodied in a method for operating a hearing device, and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
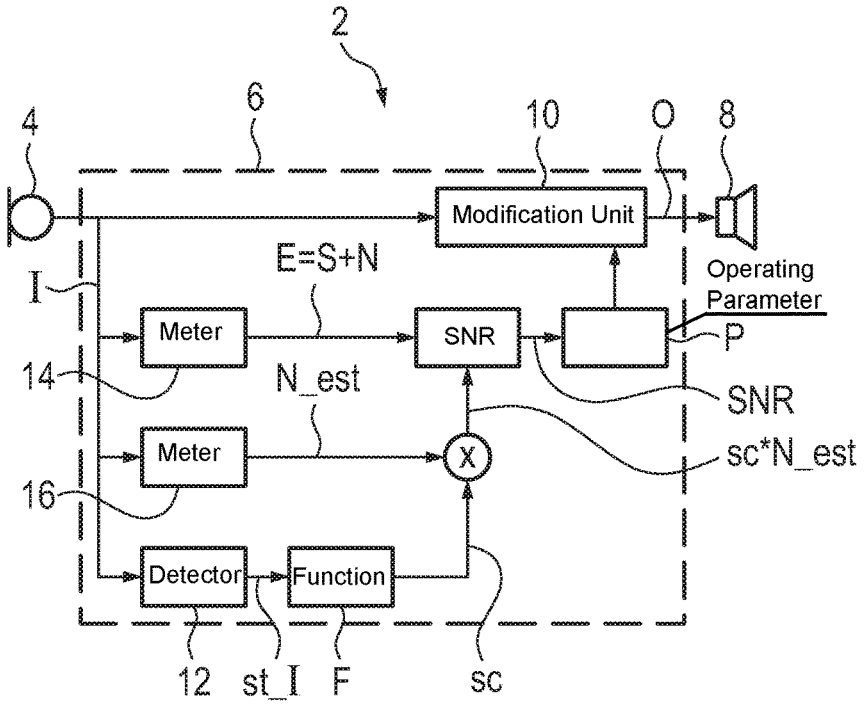
FIG. 1 is a block diagram of a hearing device according to the invention.
Figure 8:
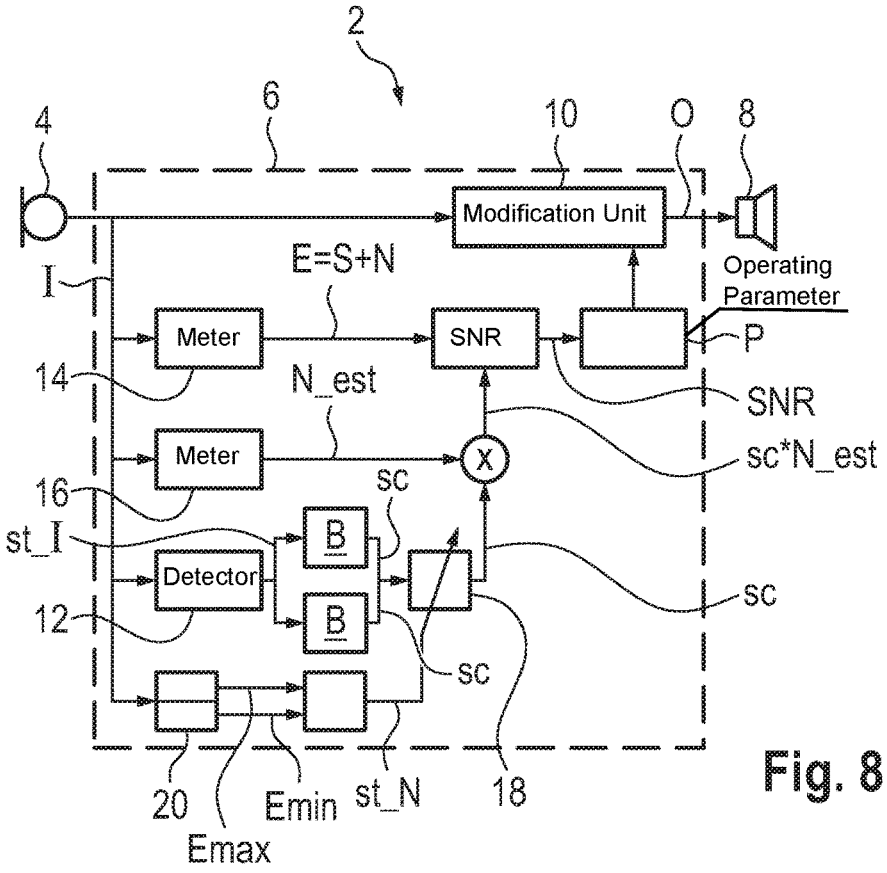
FIG. 8 is a block diagram showing a variant of the hearing device from FIG. 1.

Referring now to the figures of the drawings in detail and first, particularly to FIG. 1 thereof, there is shown an exemplary embodiment of a hearing device 2. A variant of the hearing device 2 is shown in FIG. 8. During a method for operating the hearing device 2 the latter is worn by a user, not depicted, in or on the ear and used to output ambient sound. The hearing device 2 has a microphone 4 by means of which ambient sound is picked up and is converted into an input signal I. The microphone 4 here is an omnidirectional microphone, which means that the input signal I is an omnidirectional signal. The input signal I has a wanted component S (signal) and a noise component N (noise). The hearing device 2 in the examples shown has a signal processing section 6 to which the input signal I is supplied for further processing. The signal processing section 6 generates an electrical output signal O, which is output to the user via a receiver 8 of the hearing device 2 as sound. In the present case the hearing device 2 is specifically a hearing device 2 to compensate for a hearing deficiency in a user with impaired hearing. Accordingly, the input signal I is modified in the signal processing section 6 by means of a modification unit 10 on the basis of an individual audiogram of the user and is in particular amplified in the process in order to compensate for the hearing deficiency. The concepts described here are also applicable to other hearing devices, however.

During the operation of the hearing device 2 a stationarity st_I of the input signal I is determined. To this end, the hearing device 2 has a stationarity detector 12, to which the input signal I is supplied and which outputs the stationarity st_I. Stationarity is generally understood to mean a measure of the variability of a signal over the course of time.

Figure 2:
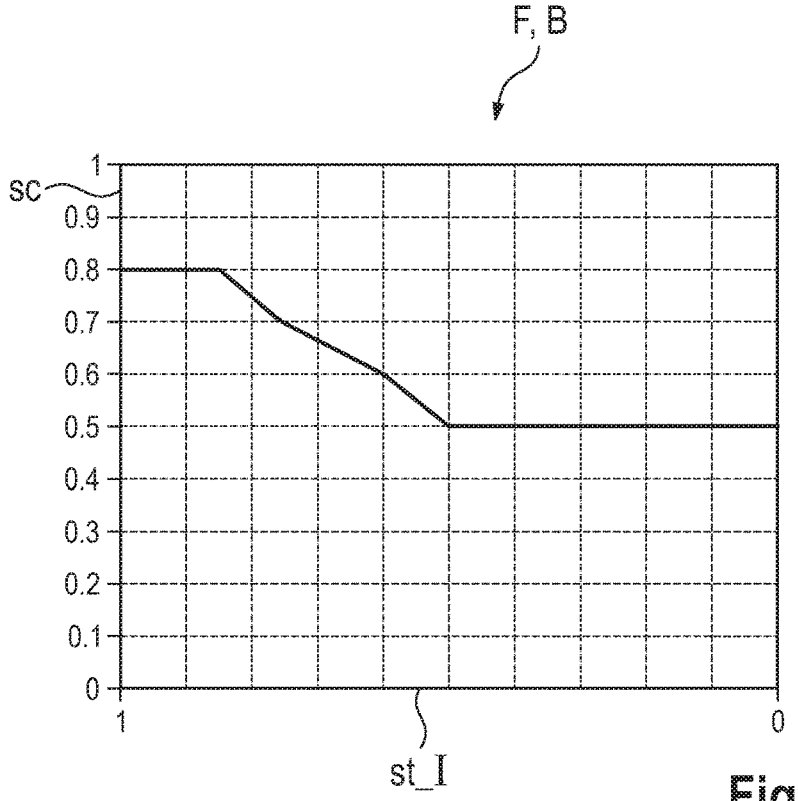
FIG. 2 is a graph showing a function for a scaling factor.
Figure 5:
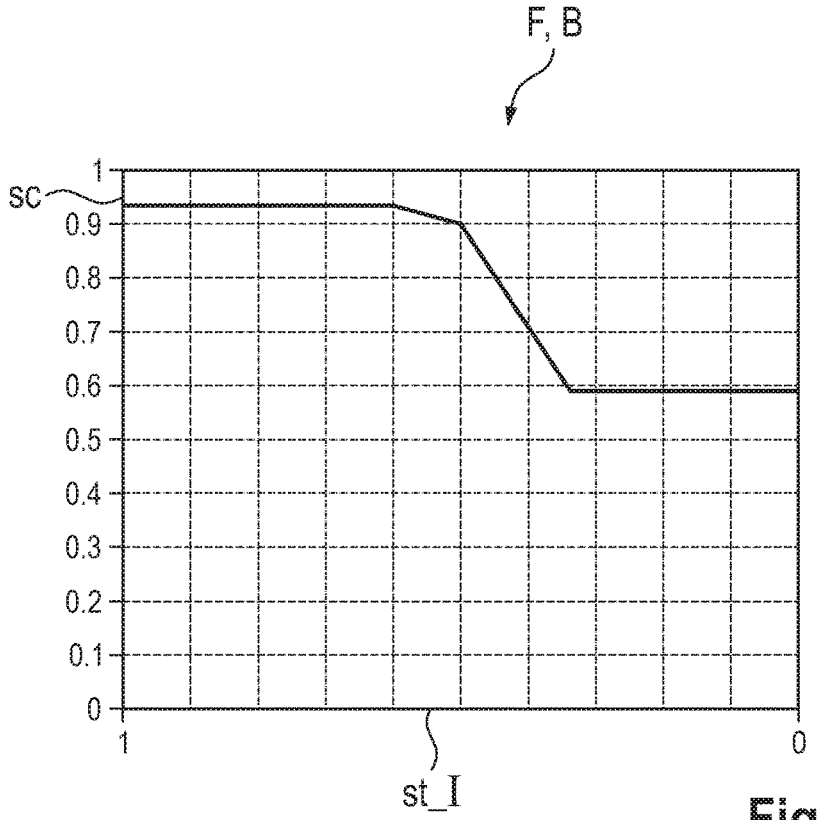
FIG. 5 is a graph showing a variant of the function from FIG. 2.

Furthermore, a signal-to-noise ratio SNR of the input signal I is determined on the basis of a scaling factor sc. The signal-to-noise ratio SNR is a measure of the relative proportions of the wanted component S and the noise component N in the overall input signal I and hence also in the ambient sound. The scaling factor sc is determined on the basis of stationarity, namely on the basis of a function F that indicates the scaling factor sc on the basis of the stationarity st_I of the input signal I. Two examples of such a function F are shown in FIGS. 2 and 5.

In the present case the signal-to-noise ratio SNR is determined, to be more precise estimated, on the basis of the input signal I. The signal-to-noise ratio SNR determined using the method thus does not necessarily correspond to the actual signal-to-noise ratio SNR_t, but rather is an estimate. FIGS. 3, 4, 6 and 7 show comparisons of the estimated signal-to-noise ratio SNR with the actual signal-to-noise ratio SNR_t, wherein the determination of the estimated signal-to-noise ratio SNR in FIGS. 3 and 4 involved the function F from FIG. 2 being used and the determination of the estimated signal-to-noise ratio SNR in FIGS. 6 and 7 involved the function F from FIG. 5.

The estimated signal-to-noise ratio SNR is used for example to adjust an operating parameter P of the hearing device 2. The operating parameter P is e.g. a parameter of a beamformer or a parameter of a noise reduction system.

Specifically how the signal-to-noise ratio SNR is calculated is initially unimportant for the underlying concept; instead it is initially only significant that the stationarity st_I is taken into consideration. In the exemplary embodiments shown here, specifically an input level E of the input signal I is measured and an estimated noise component N_est of the input signal I is determined. The estimated noise component N_est is multiplied by the scaling factor sc, so that a scaled, estimated noise component sc*N_est is obtained. The signal-to-noise ratio SNR is then calculated by forming a difference from the input level E and the scaled, estimated noise component sc*N_est and by calculating the signal-to-noise ratio SNR as the ratio of the difference to the scaled, estimated noise component sc*N_est. This approach is expressed by the following formula:

$$SNR=(E-sc*N_est)/sc*N_est=(S+N-sc*N_est)/sc*N_est.$$

Both the input level E and the estimated noise component N_est are derived directly from the input signal I without knowledge of the wanted component S and the noise component N. The noise component N and the wanted component S are not separated.

The numerator in the above formula corresponds to an estimated wanted component and the denominator corresponds to an estimated noise component, so that all in all an estimated signal-to-noise ratio SNR is calculated. The indicated formula can particularly also be used to represent a negative signal-to-noise ratio SNR. In a variant that is not shown, the scaling factor sc in the denominator in said formula is omitted and the estimated wanted component in the numerator is merely divided by the estimated noise component N_est.

In the examples shown, the hearing device 2 has a first level meter 14, which is used to determine the input level E, and a separate, second level meter 16, which is used to determine the estimated noise component N_est. The input signal I is accordingly supplied to two different level meters 14, 16. The second level meter 16 is used to estimate the noise component N in the input signal E by virtue of the second level meter 16 being adjusted such that it primarily measures the level of the noise component N, that is to say responds to the wanted component S less acutely. The two level meters 14, 16 are accordingly configured differently in order to perform different level measurements on the input signal I. The second level meter 16 is operated with two asymmetric time constants here, namely with an attack that is longer than a release. The second level meter 16 is therefore also referred to as a "minimum tracker".

The functions F in FIGS. 2 and 5, which each indicate the scaling factor sc on the basis of the stationarity st_I, are in a form such that a greater scaling factor sc is determined when the stationarity st_I of the input signal E is greater. In FIGS. 2 and 5 the stationarity st_I is plotted horizontally and decreases as viewed from left to right. The scaling factor sc is plotted vertically and increases from bottom to top. The functions F show the consideration that when the stationarity st_I is greater the proportion of the wanted component S in the input signal E is smaller, which means that a larger correction is required, which is then achieved by means of the greater scaling factor sc. The functions F shown by way of example here are in stepped or ramped form by and large and in this regard have an approximately linear profile over a middle section and otherwise a predominately constant profile over lateral sections. The two functions F explicitly shown in FIGS. 2 and 5 differ firstly in respect of the range of values for the scaling factor sc and secondly in respect of the position of the middle section, that is to say in which range of values for the stationarity st_I the respective function F has an approximately linear profile. In FIG. 2 the function F for the scaling factor sc has a range of values from 0.51 to 0.8. In FIG. 5 the function F for the scaling factor sc has a range of values from 0.59 to 0.95 and is higher by and large than the function F in FIG. 2.

Figure 3:
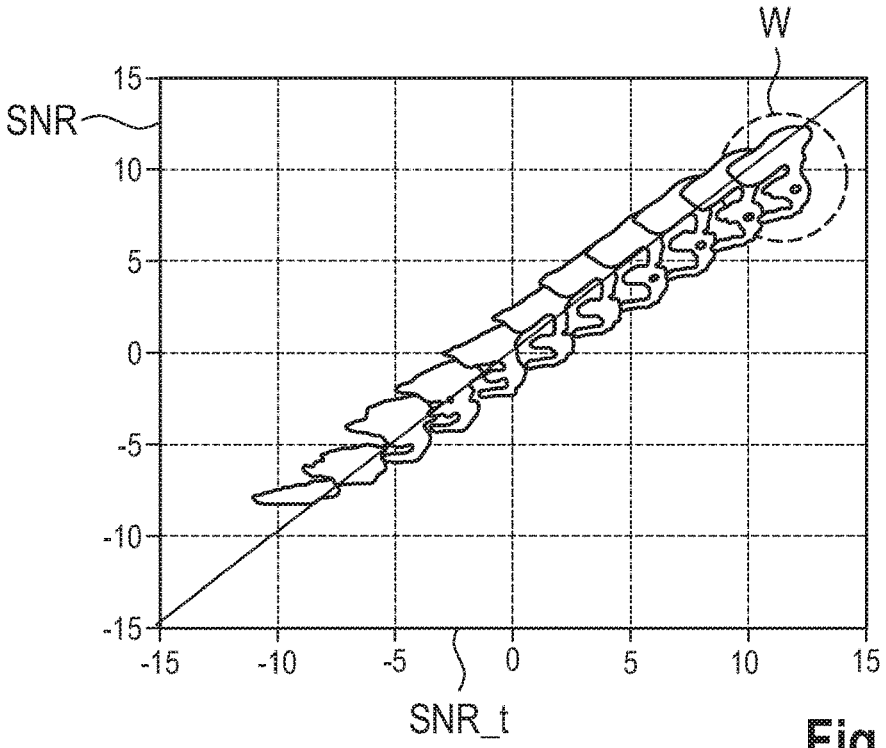
FIG. 3 is a graph showing one actual and one estimated signal-to-noise ratio for a stationary noise component.
Figure 4:
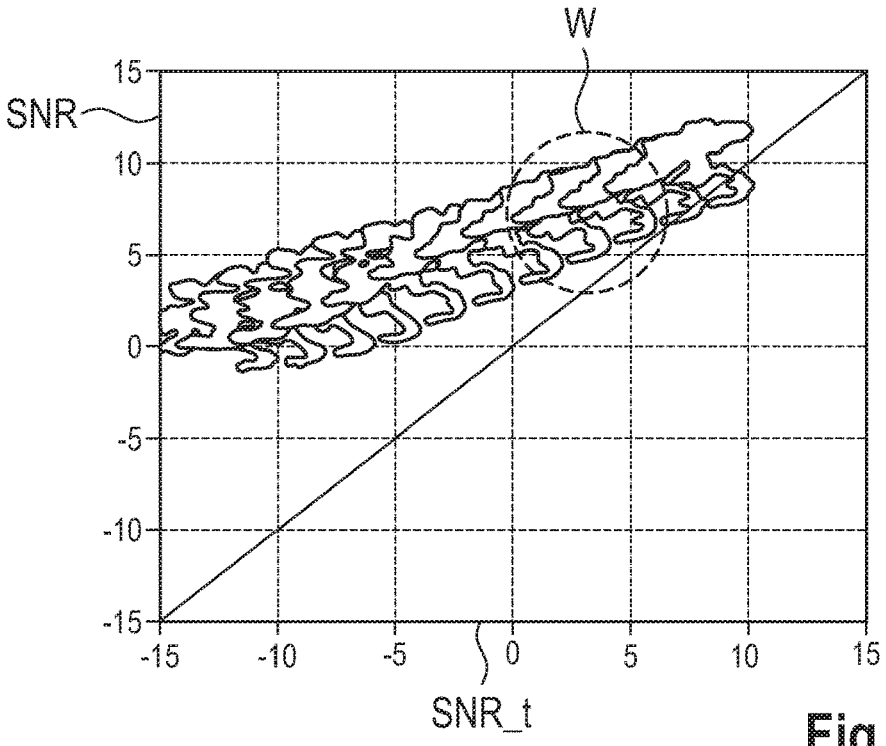
FIG. 4 is a graph showing one actual and one estimated signal-to-noise ratio for a nonstationary noise component.

The function F in FIG. 2 was ascertained by means of a calibration measurement as illustrated in FIGS. 3 and 4. A similar situation applies for the function F in FIG. 5 with reference to FIGS. 6 and 7. The respective calibration measurement initially involves the actual signal-to-noise ratio SNR_t being determined for different ratios of a wanted signal S and a noise signal N, said actual signal-to-noise ratio being plotted horizontally in each of FIGS. 3, 4, 6 and 7 and being indicated in dB. The actual signal-to-noise ratio SNR_t is then compared with the signal-to-noise ratio SNR calculated using the above formula and using the respective function F. The calculated signal-to-noise ratio SNR is plotted vertically in each of FIGS. 3, 4, 6 and 7 and likewise indicated in dB. Multiple point clouds W, in FIG. 3 specifically 11 of them, one of which is marked by a circle as an example, are shown in each case. FIGS. 4 and 7 each also reveal 11 point clouds W, whereas in FIG. 6 there are only 10. In the present case, the same wanted signal S was used for the point clouds W in each of FIGS. 3, 4, 6 and 7 and the mean level of the noise signal N was increased in steps. A respective point cloud W is obtained by virtue of the signal-to-noise ratios SNR, SNR_t being plotted for different times, wherein the level for the wanted signal S fluctuates over time, since the wanted signal S is e.g. voice, which accordingly varies over time.

Figure 6:
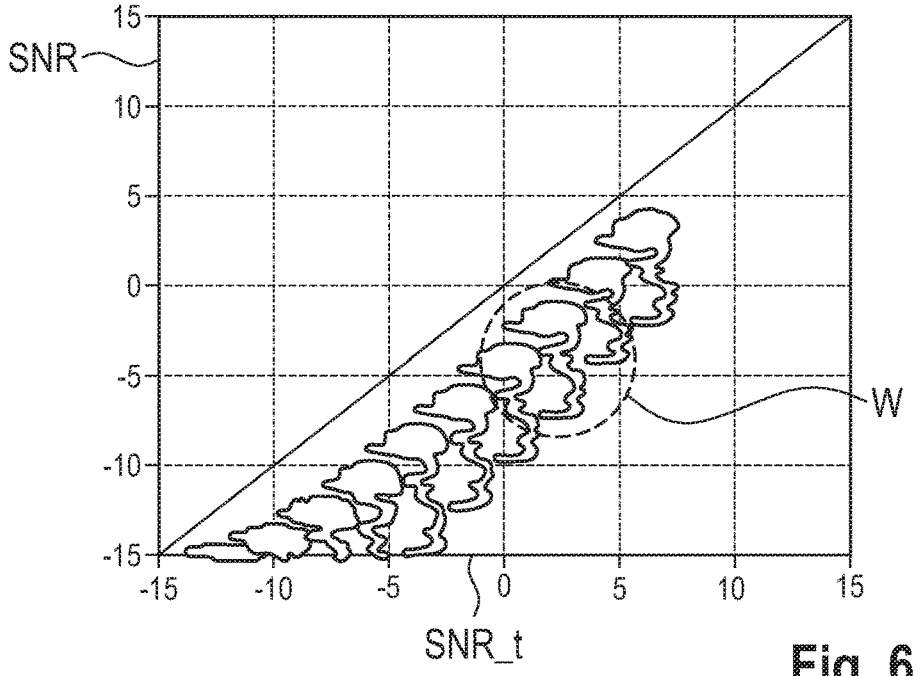
FIG. 6 is a graph showing one actual and one estimated signal-to-noise ratio for a stationary noise component.
Figure 7:
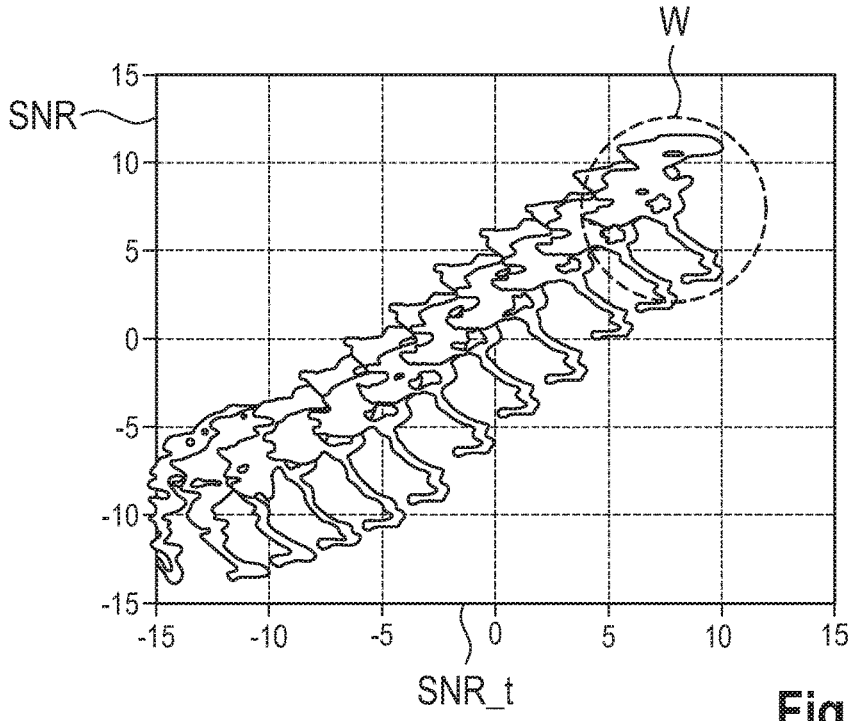
FIG. 7 is a graph showing one actual and one estimated signal-to-noise ratio for a nonstationary noise component.

In each of FIGS. 3 and 6 a stationary noise component S was used, namely what are known as long-term average speech spectra, LTASS for short. In FIGS. 4 and 7, on the other hand, a nonstationary noise component S, namely what is known as "babble noise", was used. It is immediately evident from the figures that the function F in FIG. 2 is better suited to noise components S having high stationarity st_N and that the function F in FIG. 5 is better suited to noise components N having low stationarity st_N. As FIG. 4 shows, the signal-to-noise ratio SNR for low-stationarity noise components N is increasingly overestimated toward a low actual signal-to-noise ratio SNR_t, whereas the estimation for stationary noise components N is very good, as FIG. 3 shows. FIGS. 6 and 7 show a converse result for application of the function F shown in FIG. 5. As FIG. 7 shows, the estimation of the signal-to-noise ratio SNR for nonstationary noise components N is very good; as FIG. 6 shows, the signal-to-noise ratio SNR for stationary noise components N is underestimated.

Depending on the stationarity st_N of the noise component N the estimation of the signal-to-noise ratio SNR in accordance with the procedure therefore sometimes delivers different results even though the respective underlying, actual signal-to-noise ratio SNR_t=S/N is actually the same. It becomes clear that, particularly in the case of an input signal I in which the wanted component S is small in comparison with the noise component N and in which the noise component N has a low stationarity st_N, the wanted component S is overestimated and the estimation of the signal-to-noise ratio SNR in accordance with the procedure is too high. This also becomes clear in view of the estimated noise component N_est. Determination thereof using the level meter 16 described above involves primarily stationary components being taken into consideration, so that a highly nonstationary noise component N is captured only incompletely or not at all and the noise component N is increasingly underestimated as the stationarity st_N thereof decreases. This problem is solved in the present case by virtue of the function F for the scaling factor sc being adapted on the basis of the stationarity st_N of the noise component N. The adaptation of the function F here is such that said function returns a greater scaling factor sc for a lower stationarity st_N of the noise component N, i.e. the scaling factor sc is corrected upward as stationarity st_N decreases. This becomes clear when comparing FIGS. 2 and 5: the scaling factor is chosen to be much greater according to the function F in FIG. 5, which is optimized for nonstationary noise components N, than according to the function F in FIG. 2, which is optimized for stationary noise components N.

In the case of the hearing device 2 in FIG. 2 just a single function F is used for the scaling factor sc. In the variant of the hearing device 2 shown in FIG. 8, on the other hand, multiple different basic functions B are used, which are optimized for noise components N having different stationarity st_N. In the case of the hearing device 2 in FIG. 8 the function F for the scaling factor sc is then adapted on the basis of a stationarity st_N of the noise component N by virtue of the function F being mixed from multiple basic functions B and on the basis of the stationarity st_N. In the exemplary embodiment shown, there are two basic functions B available and the function F is determined by virtue of the two basic functions B being mixed with one another in a mix ratio that is dependent on the stationarity st_N. This achieves a soft transition when using different basic functions B. By way of example the two functions F in FIGS. 2 and 5 are each used as a basic function B.

In order to mix the basic functions B the hearing device 2 in FIG. 8 has a mixer 18, to which the scaling factors sc from multiple basic functions B are supplied. The mixer 18 then mixes these scaling factors sc in an appropriate mix ratio on the basis of the stationarity st_N and then itself outputs a scaling factor sc, which is finally multiplied by the estimated noise component N_est in order to ascertain the scaled, estimated noise component sc*N_est.

In a variant of the hearing device 2 that is not shown, the function F for the scaling factor sc is adapted on the basis of the stationarity st_N of the noise component N by virtue of the function F for the scaling factor sc being selected from at least two basic functions B, for example the functions F shown in FIGS. 2 and 5.

In one possible configuration the hearing device 2 has multiple frequency channels, not depicted explicitly here, so that the input signal I is split over these multiple frequency channels. The signal-to-noise ratio SNR is then determined analogously for some or all of the other frequency channels too. For the purpose of output the frequency channels are combined again. For example a filter bank is used for the purpose of splitting over the different frequency channels. The signal-to-noise ratio SNR is, for example, calculated for each frequency channel from a partial number of the frequency channels as described above, so that multiple signal-to-noise ratios SNR are obtained, from which a mean value is then formed in an averaging unit, which mean value is an averaged signal-to-noise ratio SNR, which is also referred to as a global signal-to-noise ratio SNR. An individual, local signal-to-noise ratio SNR is ascertained for each of the partial number of the frequency channels, separately as it were. The estimation of the signal-to-noise ratio SNR therefore explicitly does not involve all frequency channels being taken into consideration, but rather some frequency channels are omitted by virtue of just a partial number of the frequency channels being taken into consideration. By way of example the partial number of the frequency channels covers a frequency range up to 1.5 kHz, i.e. only low frequencies are taken into consideration for the estimation of the signal-to-noise ratio SNR.

The determination of the signal-to-noise ratio SNR does not necessarily completely have to be performed separately for each of the frequency channels; instead it is sufficient for individual calculations, determinations, ascertainments or measurements to be performed on a frequency-dependent basis, i.e. for individual frequency channels, with other calculations, determinations, ascertainments or measurements then being performed globally, i.e. not on a frequency-dependent basis. By way of example, in the case of the hearing device 2 in FIG. 2 the stationarity st_I of the input signal I is determined on a frequency-dependent basis and just for a partial number of the frequency channels, is averaged, and then the scaling factor sc is determined. The input level E and the estimated noise component N_est are ascertained globally or on a frequency-dependent basis.

The stationarity st_N of the noise component N is determined in the exemplary embodiments shown by virtue of the temporal dynamics of the input signal I being analyzed, namely by virtue of a maximum level Emax and a minimum level Emin of the input signal I being ascertained and being compared with one another. By way of example, the difference between or the ratio of the maximum level Emax and the minimum level Emin is ascertained. In this way, the stationarity st_N is ascertained without having to know the noise component N explicitly. This exploits the circumstance that, specifically when the actual signal-to-noise ratio SNR_t is low, a higher stationarity st_N of the noise component N leads to a smaller difference between the maximum level Emax and the minimum level Emin. The function F is then adapted such that when the difference is greater a lower stationarity st_N is assumed and therefore a correspondingly adapted scaling factor sc is used. A third and a fourth level meter 20 are used in the present case, which are supplied with the input signal I and which determine the maximum level Emax and the minimum level Emin and therefore also the stationarity st_N.

LIST OF REFERENCE SIGNS

2 hearing device
4 microphone
6 signal processing section
8 receiver
10 modification unit
12 stationarity detector
14 first level meter
16 second level meter
18 mixer
20 third and fourth level meters
E input level
Emax maximum level
Emin minimum level
F function
I input signal
N noise component
N_est estimated noise component
O output signal
P operating parameter
S wanted component
sc scaling factor
sc*N_est scaled, estimated noise component
SNR (estimated) signal-to-noise ratio
SNR_t actual signal-to-noise ratio
st_I stationarity of the input signal
st_N stationarity of the noise component
W point cloud

The invention claimed is:

1. A method for operating a hearing device having a microphone, which comprises the steps of:
- picking up and converting an ambient sound into an input signal having a wanted component and a noise component via the microphone;
- determining a stationarity of the input signal; and
- determining a signal-to-noise ratio of the input signal on a basis of a scaling factor, wherein the scaling factor is determined on a basis of the stationarity, namely on a basis of a function that indicates the scaling factor on a basis of the stationarity of the input signal.

2. The method according to claim 1, which further comprises:
- measuring an input level of the input signal;
- determining an estimated noise component of the input signal and the estimated noise component is multiplied by the scaling factor, so that a scaled, estimated noise component is obtained; and
- calculating the signal-to-noise ratio by virtue of a difference being formed from the input level and the scaled, estimated noise component and by virtue of the signal-to-noise ratio being calculated as a ratio of a difference to the scaled, estimated noise component.

3. The method according to claim 2, wherein the hearing device has a first level meter and a second level meter, and the method further comprises the steps of:
- using the first level meter to determine the input level; and
- using a second level meter to determine the estimated noise component.

4. The method according to claim 3, which further comprises determining the estimated noise component using the second level meter that is operated with two asymmetric time constants.

5. The method according to claim 4, wherein the second level meter is operated with an attack that is longer than a release of the second level meter.

6. The method according to claim 1, wherein the function is in a form such that a greater scaling factor is determined when the stationarity is greater.

7. The method according to claim 1, wherein the function is predefined by means of a calibration measurement that involves an actual signal-to-noise ratio being determined for different ratios of the wanted component and the noise component and the actual signal-to-noise ratio being compared with a calculated signal-to-noise ratio.

8. The method according to claim 1, wherein the function for the scaling factor is adapted on a basis of the stationarity of the noise component.

9. The method according to claim 8, which further comprises determining the stationarity of the noise component by virtue of temporal dynamics of the input signal being analyzed.

10. The method according to claim 8, which further comprising selecting the function for the scaling factor from at least two basic functions on a basis of the stationarity of the noise component.

11. The method according to claim 8, wherein there are two basic functions available and the function is determined by virtue of the two basic functions being mixed with one another in a mix ratio that is dependent on the stationarity of the noise component.

12. The method according to claim 1, wherein the hearing device has multiple frequency channels, and the method further comprises calculating the signal-to-noise ratio for each frequency channel from a partial number of the frequency channels, so that multiple signal-to-noise ratios are obtained, from which a mean value is then formed that is an averaged signal-to-noise ratio.

13. The method according to claim 1, wherein:

an operating parameter of the hearing device is adjusted on a basis of the signal-to-noise ratio; and the operating parameter is a parameter of a beamformer or a parameter of a noise reduction system.

14. The method according to claim 8, which further comprises determining the stationarity of the noise component by virtue of temporal dynamics of the input signal being analyzed, namely by virtue of a maximum level and a minimum level of the input signal being ascertained and being compared with one another.

15. A hearing device, comprising:

a microphone;

a receiver; and a signal processing unit connected to said microphone and said receiver, said signal processing unit configured to perform a method according to claim 1.

* * * * *